US007832249B2

(12) United States Patent
Schumann et al.

(10) Patent No.: US 7,832,249 B2
(45) Date of Patent: Nov. 16, 2010

(54) BI-CAN HAVING INTERNAL BAG

(75) Inventors: Ronald C. Schumann, Aurora, IL (US); Joseph J. Domijan, Downers Grove, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 12/490,629

(22) Filed: Jun. 24, 2009

(65) Prior Publication Data

US 2009/0257847 A1 Oct. 15, 2009

Related U.S. Application Data

(62) Division of application No. 10/679,966, filed on Oct. 6, 2003, now Pat. No. 7,575,133.

(51) Int. Cl.
*B21D 11/10* (2006.01)

(52) U.S. Cl. ..... 72/379.4; 413/5; 413/6; 413/9

(58) Field of Classification Search ..... 72/379.4; 413/1, 4, 5, 6, 9, 22, 27, 31, 32, 72, 73, 74, 413/75; 156/69; 264/320, 322, 544; 425/392, 425/398

See application file for complete search history.

(56) References Cited

U.S. PATENT DOCUMENTS

| | | | | |
|---|---|---|---|---|
| 2,339,763 | A | | 1/1944 | Calleson et al. |
| 3,548,564 | A | * | 12/1970 | Bruce et al. ..... 53/470 |
| 3,788,521 | A | | 1/1974 | Laauwe |
| 3,896,970 | A | | 7/1975 | Laauwe |
| 3,905,517 | A | | 9/1975 | Friedrich et al. |
| 3,995,572 | A | | 12/1976 | Saunders |
| 4,032,064 | A | | 6/1977 | Giggard |
| 4,045,860 | A | | 9/1977 | Winckler |
| 4,117,951 | A | | 10/1978 | Winckler |
| 4,148,146 | A | | 4/1979 | Holland |
| 4,150,522 | A | | 4/1979 | Birger |

(Continued)

FOREIGN PATENT DOCUMENTS

| | | |
|---|---|---|
| DE | 92 11 788 U1 | 2/1993 |

(Continued)

OTHER PUBLICATIONS

Johnsen, M.A., The Aerosol Handbook, 1982, 2.sup.nd Edition, 163 pages. Cited by other.

*Primary Examiner*—Edward Tolan
(74) *Attorney, Agent, or Firm*—Woodcock Washburn LLP

(57) ABSTRACT

A can assembly includes a can body, and a cap that is seamed to the can body, and a bag. The bag, which may be formed by a thermoforming process, includes a thickened portion as part of a peripheral flange that terminates in a bulb. A throat that receives the bulb is formed by necks on the body and cap such that the bulb is spaced apart from the seam. A constriction formed by the neck radially inboard from the bulb receives the thickened portion of the bag. The process for forming the can assembly includes forming the seam and thermoforming a billet into the bag. At least part of the flange is formed between matched portions of mold flanges.

8 Claims, 11 Drawing Sheets

U.S. PATENT DOCUMENTS

| | | | | | |
|---|---|---|---|---|---|
| 4,185,758 | A | | 1/1980 | Giggard | |
| 4,293,353 | A | | 10/1981 | Pelton et al. | |
| 4,308,973 | A | | 1/1982 | Irland | |
| 4,313,545 | A | | 2/1982 | Maeda | |
| 4,346,743 | A | | 8/1982 | Miller | |
| 4,423,829 | A | | 1/1984 | Katz | |
| 4,449,871 | A | | 5/1984 | Hillestad | |
| 4,464,109 | A | * | 8/1984 | Giangiulio et al. | 431/344 |
| 4,667,384 | A | * | 5/1987 | Miller | 29/509 |
| 4,775,071 | A | | 10/1988 | Giggard | |
| 5,005,733 | A | | 4/1991 | Stoody | |
| 5,007,556 | A | | 4/1991 | Lover | |
| 5,217,139 | A | | 6/1993 | Miczka et al. | |
| 5,248,063 | A | | 9/1993 | Abbott | |
| 5,277,336 | A | | 1/1994 | Youel | |
| 5,388,716 | A | | 2/1995 | Stoffel et al. | |
| D375,684 | S | | 11/1996 | Hope | |
| 5,797,522 | A | | 8/1998 | Evans et al. | |
| 5,915,595 | A | | 6/1999 | Dow et al. | |
| 5,964,021 | A | | 10/1999 | Stoffel | |
| 6,073,804 | A | | 6/2000 | Yquel | |
| 6,196,275 | B1 | | 3/2001 | Yazawa et al. | |
| 6,196,421 | B1 | | 3/2001 | Williams | |
| 6,230,943 | B1 | | 5/2001 | Miyamoto et al. | |
| 6,332,563 | B2 | | 12/2001 | Baudin | |
| 6,401,979 | B1 | | 6/2002 | Mekata et al. | |
| 6,419,129 | B1 | | 7/2002 | Abplanalp | |
| 6,439,430 | B1 | | 8/2002 | Gilroy, Sr. et al. | |
| 6,547,503 | B1 | | 4/2003 | Bohm et al. | |
| 7,017,772 | B2 | * | 3/2006 | Meiland et al. | 220/613 |
| 7,255,552 | B2 | * | 8/2007 | Michelon et al. | 425/384 |

FOREIGN PATENT DOCUMENTS

| | | | |
|---|---|---|---|
| WO | 03/018294 | * | 3/2003 |

* cited by examiner

BI-CAN HAVING INTERNAL BAG

CROSS-REFERENCE TO RELATED APPLICATIONS

This application is a divisional of U.S. patent application Ser. No. 10/679,966 filed Oct. 6, 2003, which is incorporated herein by reference in its entirety.

TECHNICAL FIELD

This invention relates to pressurized containers, and more particularly to pressurized containers having an internal container, such as a bag, for dispensing contents through a nozzle.

BACKGROUND

Some conventional aerosol can assemblies include a can body, a cap coupled to the can body, a nozzle disposed in the cap, and an inner container, such as a bag. A product is disposed in the bag, and the plenum outside of the bag is pressurized. Accordingly, upon creating an opening by actuating the nozzle, product is dispensed out of the can. In many popular configurations, an end of the bag is disposed in the coupling or seam between the nozzle and the cap, and in other prior art references the bag is disposed in the coupling or seam between the cap and the can body.

Bags are often formed of a nylon material having good barrier properties to common propellants, such as propane or isobutene. Because conventional bags are prone to damage if not within a particular humidity range, the bags may be damaged while being inserted through the top opening in the cap, which typically is smaller than the bag diameter. Also, conventional bags are prone to being ruptured in some conventional processes in which bags are formed as part of a seam or crimp—either between the cap and nozzle assembly or between the cap and body.

SUMMARY

A pressurizable can assembly, which is capable of dispensing a product disposed therein, includes a body including a body sidewall and a seam portion; an enclosed lower portion disposed at a bottom of the body; and a cap including a cap sidewall and a seam portion. The body seam portion and the cap seam portion form a seam for securing the body to the cap. Also, a nozzle assembly is disposed at an upper portion of the cap. A portion of the body and a portion of cap form a throat formed therebetween. The throat, which may include an annulus that is separated from the main portion of the container by a constriction, generally terminates proximate or at the seam. An inner container, such as a bag, is disposed at least partly in the can body and includes peripheral thickened portion at an upper edge thereof. The thickened portion is disposed in the throat and spaced apart from the seam.

Preferably, the body includes a neck and the cap includes a neck, and the throat is formed between the body neck and the cap neck. The bag flange terminates in a bulb such that the bulb is disposed in the annulus. The bulb is larger than the opening of the constriction, which prevents the bag flange from pulling out of the throat.

The bag preferably is formed by a thermoforming process, including the steps of heating a billet, disposing the billet into mold, deforming a portion of the billet to form the flange of the inner container, and deforming another portion of the billet to form the body of the inner container. The step deforming the portion of the billet includes deforming a periphery of the billet between a top mold flange and a bottom mold flange. A space between the top mold flange and bottom mold flange has a shape corresponding the bulbous end of the inner container flange. At least one of the top mold flange and the bottom mold flange are movable to enable removal of the thermoformed bag. Conventional stretching and blow molding steps may also be employed.

Accordingly, a method of forming a can assembly according to the above components and methods are also encompassed.

DETAILED DESCRIPTION OF ILLUSTRATIVE EMBODIMENTS

Figure 1A:
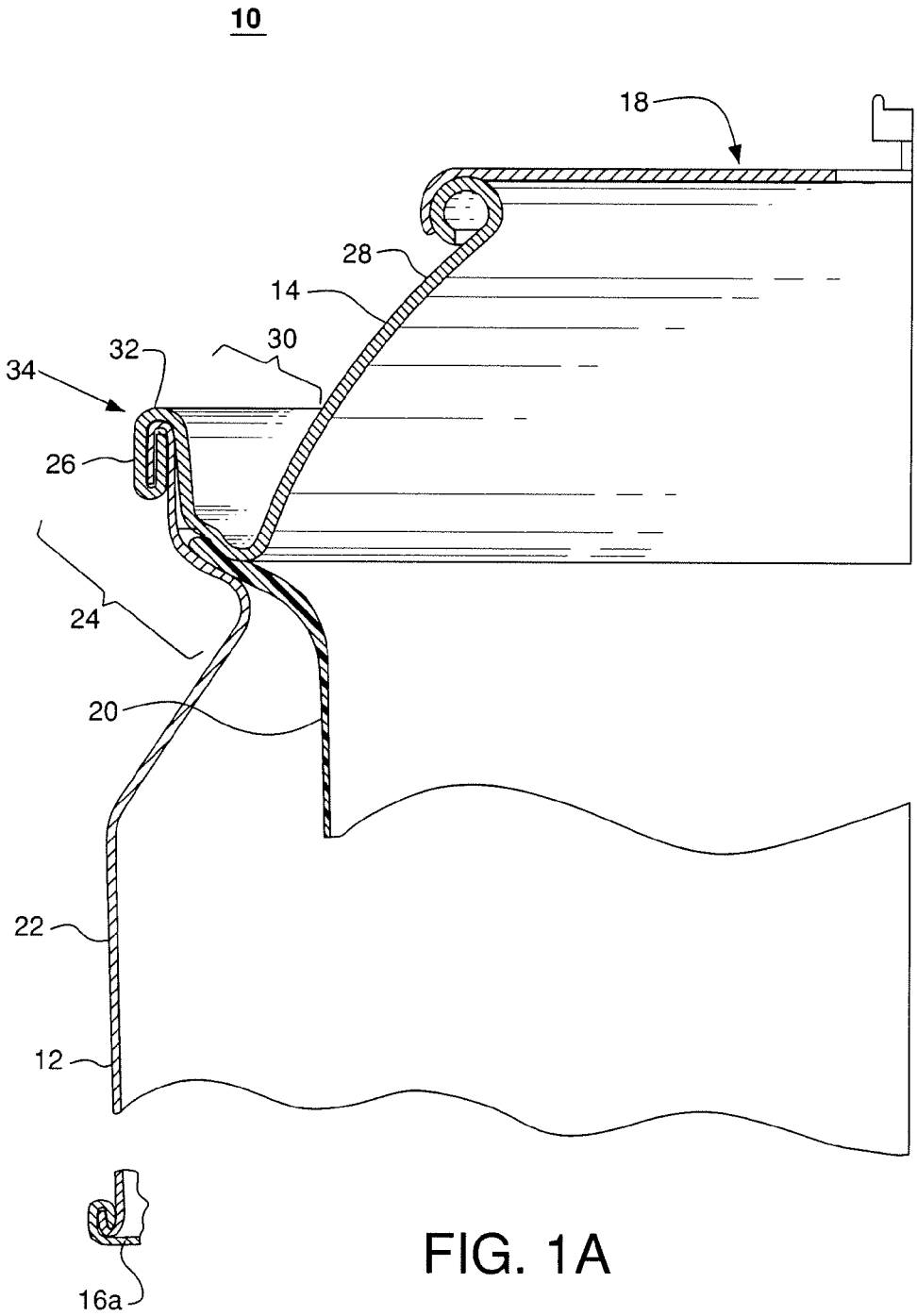
FIG. 1A illustrates a longitudinal cross sectional view of a portion of a can assembly.

As illustrated in FIG. 1A, a can assembly 10 includes a body 12, a cap 14, and an enclosed end 16 (that is, generally referring to ends 16*a* and 16*b*—the latter being shown in FIG. 2), a nozzle assembly 18, and an inner container, such as a bag 20. Can assembly 10 is suitable for containing internal pressure such that a product (not shown in the figures for clarity) disposed in bag 20 may be forced through an opening in nozzle 18 upon its actuation.

Figure 2A:
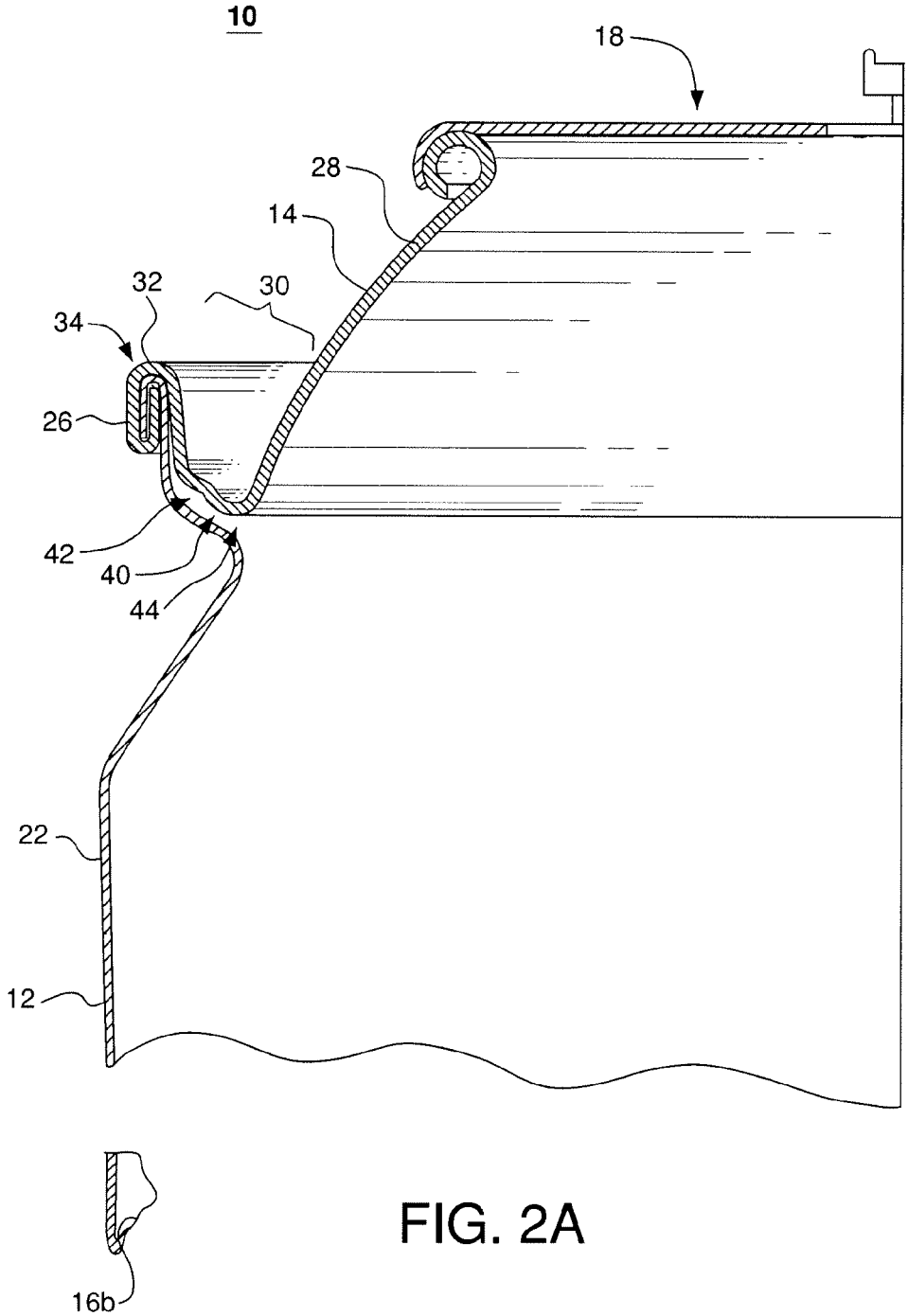
FIG. 2A is a cross sectional view of a portion of the can assembly shown in FIG. 1A, but with a portion removed for clarity.

Body 12 includes a sidewall 22 and a neck 24. Preferably, body sidewall 22 is cylindrical and, in transverse cross section (not shown in the figures), circular. FIG. 1A schematically illustrates an enclosed end 16*a* that is seamed to a lowermost rim of sidewall 22. FIG. 2A schematically illustrates an enclosed end 16*b* integrally formed with a lower end of sidewall 22. Ends 16*a* and 16*b* fully enclose and seal the lower portion of body 12, and may include a valve (not shown in the figures) for enabling pressurization with a propellant, such as propane or isobutene, as will be understood by persons familiar aerosol containers. The term "aerosol" as used herein to modify the term "can" or "container," is not limited to cans that atomize its product contents or form an aerosol spray during dispensing, but rather encompasses any container capable of receiving a propellant and discharging contained product contents, in any manner, through an opening upon actuation of a valve or nozzle by a user.

In some configurations, such as end 16*a* shown in FIG. 1A, a portion of the bottom end may define the maximum outer diameter of can assembly 10. For clarity, reference numeral 10 is employed to refer to a can assembly structure having either end 16*a* or 16*b*.

Figure 3A:
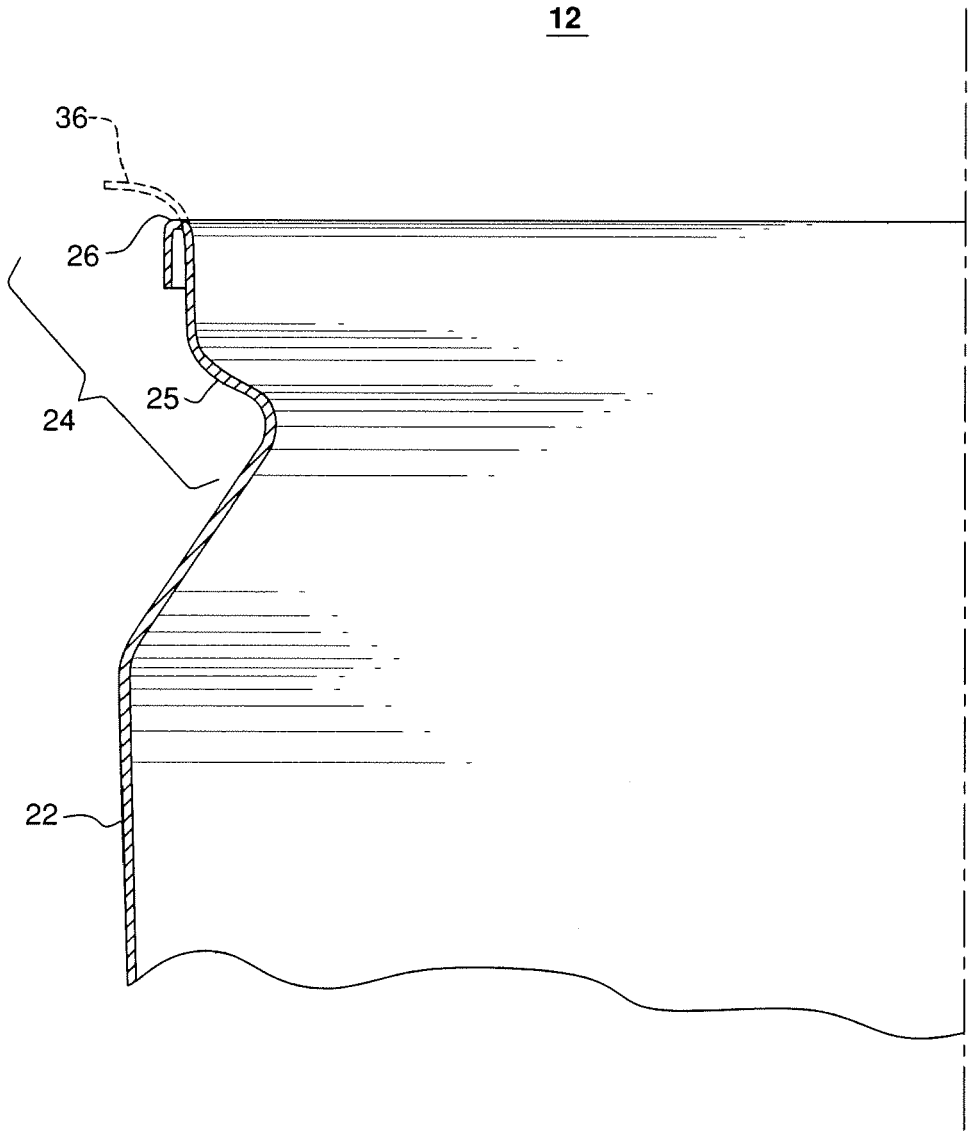
FIG. 3A is a cross sectional view of a portion of a component of the can assembly shown in FIG. 1A.

As shown in FIGS. 1A, 2A, and 3A, body sidewall 22 yields to neck 24, which generally extends radially outward and upward. Neck 24 includes a throat portion 25 and, at a distal end of neck 24, a seam portion 26. FIG. 3A illustrates neck 24 in sold lines in its final position after it has been seamed with cap 14. Its pre-seamed position is schematically shown in dashed lines indicated by reference numeral 36. In a preferred embodiment, body sidewall 22 has an outer diameter of 2.08 inches, which necks inwardly such that neck seam portion 26 has an outermost diameter that is smaller than the diameter of the majority of, or the widest part of, body sidewall 22.

Figure 4A:
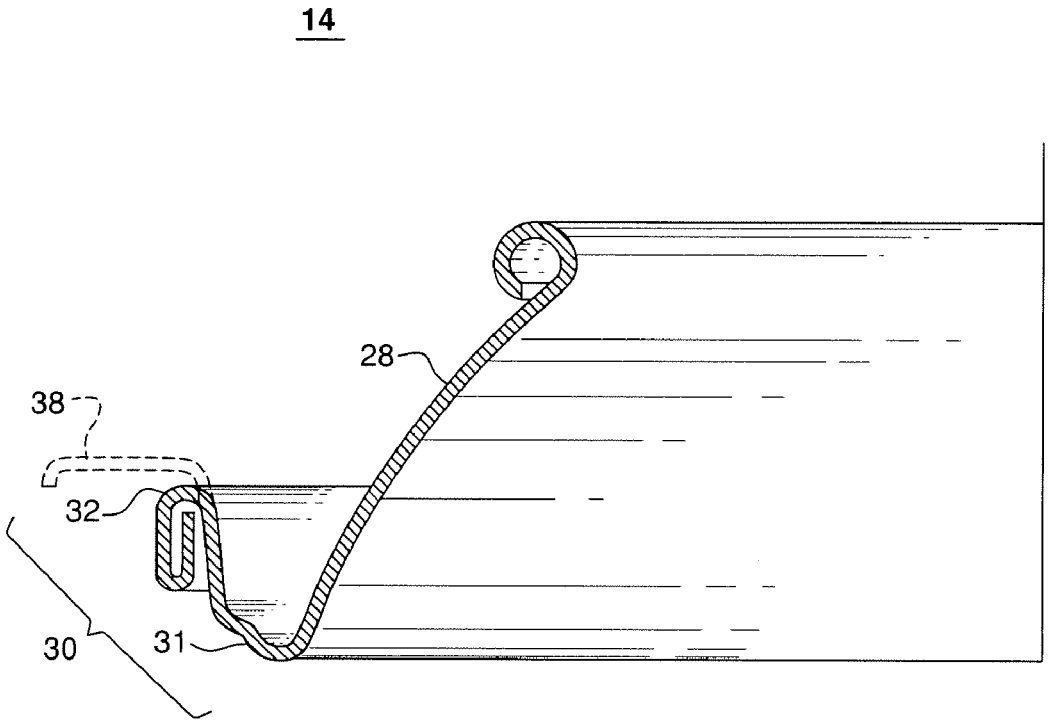
FIG. 4A is a cross sectional view of a portion of another component of the can assembly shown in FIG. 1A.

Cap 14 includes a cap sidewall 28 and a cap neck 30. Preferably, cap 14 is circular in transverse cross section (not shown in the Figures) so as to mate to body 12, and dome-shaped. As shown in FIGS. 1A, 2A, and 4A, cap sidewall 28, at its lower end, yields to neck 30, which extends radially outwardly and upwardly. Neck 30 includes a throat portion 31 and, at a distal end of neck 30, a seam portion 32. FIG. 4A illustrates cap neck 30 in solid lines in its final position after it has been seamed with cap 14. Its pre-seamed position is schematically shown in dashed lines indicated by reference numeral 38. In a preferred embodiment, cap sidewall 28 has a maximum outer diameter (that is, proximate where sidewall 28 yields to neck 30) of approximately 1.70 inches and a wall thickness of approximately 0.130 inches.

Figure 6:
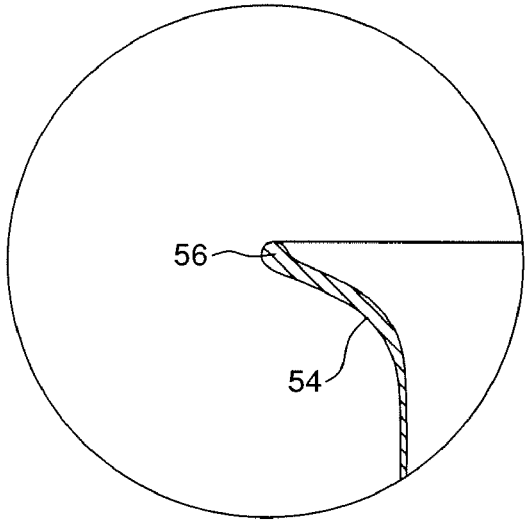
FIG. 6 is an enlarged view of the component shown in FIG. 5 taken at the portion within circle 6 in FIG. 5 such that the scale of the component is approximately like that shown in FIG. 1A.
Figure 5:
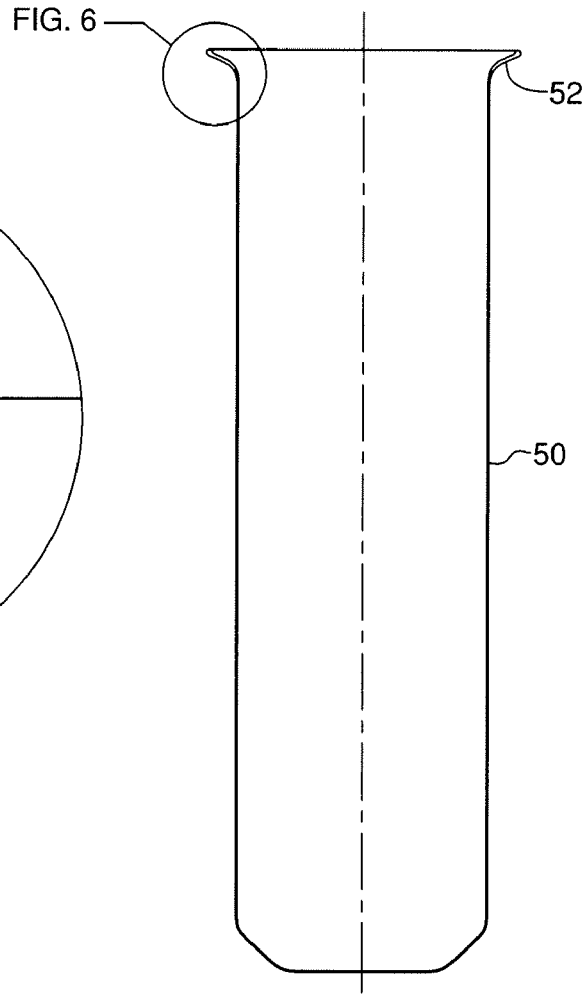
FIG. 5 is a view of another component of the can assembly shown in FIG. 1A.

As shown in FIGS. 1A, 5A, and 6A, bag 20 includes bag body 50 and a flange 52. Bag body 50 has an enclosed lower end to receive product contents. Bag flange 52 extends upwardly from body 50 and flares radially outwardly. A relatively thickened portion 54 is disposed at least on flange 52. Relatively thickened portion 54 is preferably relatively thick compared with the thickness of bag body 50, and relatively thick compared with many conventional bag thicknesses. Flange 52 terminates with a circumferential bulb 56 at a distal tip thereof.

In a typical embodiment, bag body 50 has a wall thickness of approximately 0.006 inches, thickened portion 54 has a wall thickness of approximately 0.020 inches, and bulb 56 is partly substantially circular with a diameter of approximately 0.032 inches, and bag 20 is approximately 5.5 inches tall and 1.52 inches diameter in the body and 1.86 inches diameter at the outermost portion of flange 52. Bag 20 is preferably formed of a nylon or other conventional material, as will be understood by persons familiar with aerosol container technology and consistent with the particular propellant employed. The particular material, configuration, and thicknesses of bag 20, however, may be chosen to suit the particular parameters (such as composition of propellant and product contents, design internal pressure within the plenum and bag, design shelf life, and the like, as will be understood by persons familiar with aerosol container technology and engineering).

Nozzle 18 is illustrated schematically in FIGS. 1A and 2A. Nozzle 18, as well as its attachment to an upper portion of cap 14, may be conventional. The present invention encompasses any type of nozzle, as will be understood by persons familiar with aerosol container technology and design. The mechanisms and method for pressurizing the interior of can assembly 10 and for filling bag 20 with product to be dispensed may be conventional.

Referring to FIG. 2A, which shows can assembly 10 with bag 20 omitted for clarity, body neck 24 and cap neck 30 are aligned and neck seam portion 26 is mechanically coupled to cap seam portion 32. Preferably, such coupling is in the form a seam 34, which preferably is a double seam, as will be understood by persons familiar with seaming technology and can design.

Seam 34, according to the configuration described above, may have an outermost diameter that is smaller than a maximum diameter of can assembly 10, and more preferably, smaller than a diameter of a diameter of body sidewall 22. For example, seam 34 may have an outermost diameter of approximately 1.99 inches. Such a configuration enhances packing of cans. The present invention, however, is not limited by the type of coupling between body 12 and cap 14 (unless so specified in the claims). Seam 34, with respect to both its final structure and to the configuration of the components of the body and cap entering the seamer, preferably is conventional.

A portion of body neck 24 and cap neck 30 are mutually spaced apart to form a throat 40, which includes a constriction 44 at an entrance to throat 40 and an annulus 42.

Annulus 42 has a minimum dimension (in longitudinal cross section as shown in FIG. 2) that is greater than that of constriction 44. Constriction 44 and annulus 42 are formed by a throat portion 25 of body neck 24 and a throat portion 31 of container neck 30. Throat portion 25 of neck 24 is formed on a radially outwardly extending portion of body neck 24, and throat portion 31 is formed on a radially outwardly extending portion of cap neck 30.

In the embodiment shown in FIGS. 1A and 2A, neck throat portion 25 is slightly arcuate, or may be substantially flat, and cap throat portion 31 includes a bulge so as to form annulus 42. The present invention, however, is not limited to the particular configurations of necks 24 and 30, but rather encompasses any configuration that may be chosen according to the particular engineering parameters of the intended application.

Constriction 44 is configured such that necks 24 and 30 contact thickened portion 54 in order to form a seal therewith between the propellant on the underside of flange 52 and the product contents inside bag 20. Preferably, constriction 44 defines an opening dimension of approximately 0.018 inches. Accordingly, bag thickened portion 54 is slightly compressed by the portions of neck 24 and 30 to compress bag thickened portion 54. Because bulb 56 has a dimension larger than the opening at constriction 44, bulb 56 prevents bag 20 from being pulled out (that is, radially inwardly) from throat 40. Body sidewall 22 is substantially aligned with cap sidewall 28 so as to transmit downward force, such as may occur during stacking of can assemblies during shipping and handling, without damaging bag 20. Bag 20 being spaced apart from seam 34 diminishes the tendency for a downward force to rupture bag 20. For example, annulus 42 may be configured such that bulb 56 is compressed to a degree less than or approximately equal to the compression of thickened portion 56 at constriction 44, or configured such that bulb 56 is not compressed.

Figure 8:
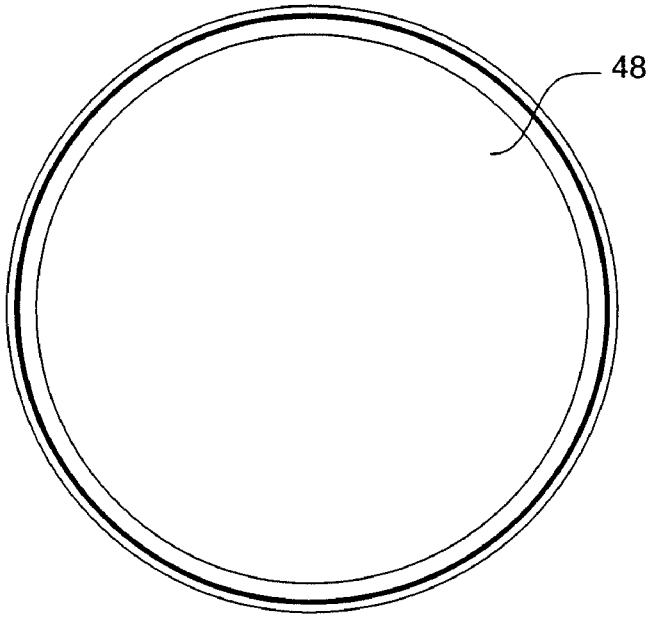
FIG. 8 is a top view of a slug employed by the mold of FIG. 7 for making the component shown in FIG. 5.
Figure 9:
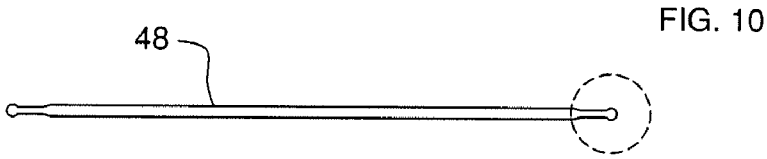
FIG. 9 is a side view of the slug shown in FIG. 8.
Figure 10:
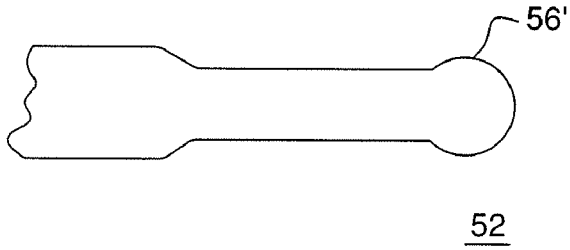
FIG. 10 is an enlarged view taken from the portion identified in FIG. 9 by reference numeral 10.

To form bag 20, a billet 48, as schematically shown in FIGS. 8-10, is disposed in a mold 60 having as its shape the exterior shape of bag 20. For the embodiment shown in the Figures, billet 48 is formed of a conventional nylon-based polymer approximately 0.050 inches thick and 2.5 inches diameter. Preferably, the bulbous end 56 at least a portion of thickened portion 56 are at least partially preformed on billet 48. The present invention is not limited to such structure of billet 48, and encompasses forming the structure of flange 52 by other means.

Figure 7:
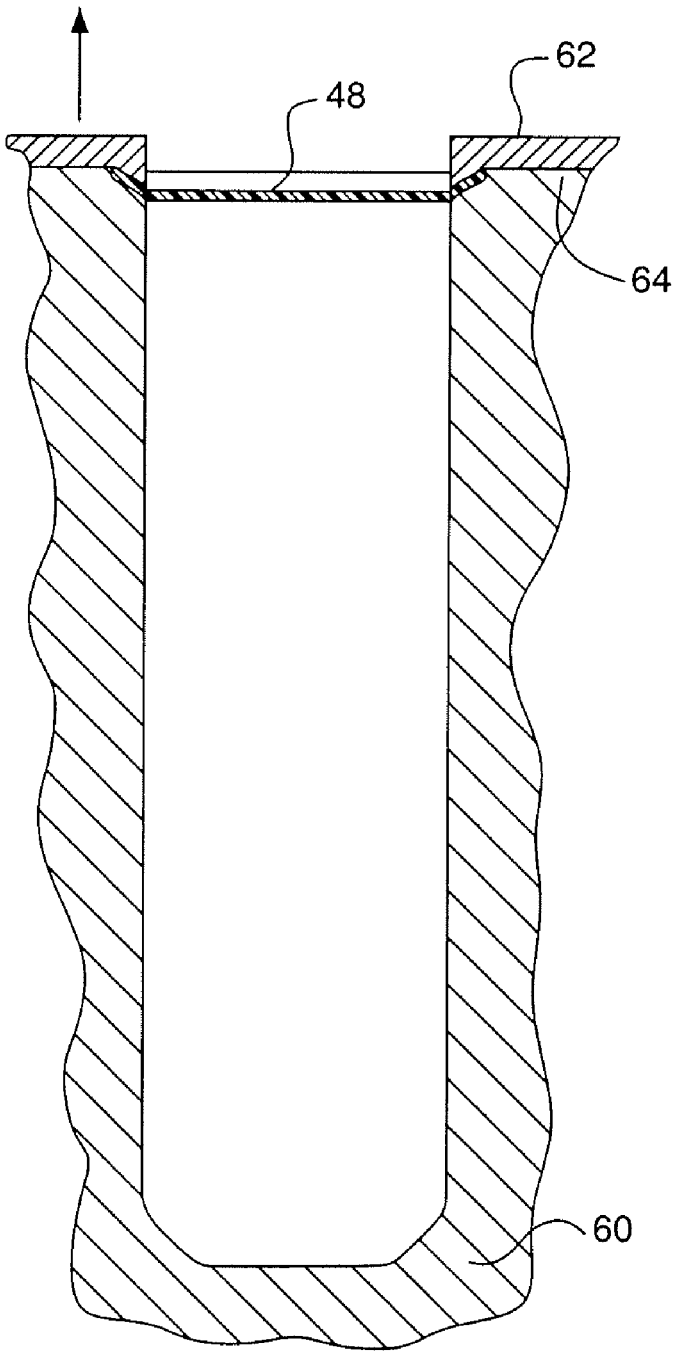
FIG. 7 is a cross sectional view of a mold assembly for making the component shown in FIG. 5.

Billet 48, which is heated typically to approximately 400 hundred degrees (although the heating temperature may be chosen according to the desired parameters of the particular application), is disposed in a mold 60 between a pair of matched mold flanges, such as an upper mold flange 62 and a lower mold flange 64. Mold 60 is shown in FIG. 7. Billet 48 is shown in FIG. 7 in dashed lines to indicate that it is in an intermediate state prior to expansion of billet 48.

Mold flanges 62 and 64 form a cavity that matches the shape of bag flange 52. Accordingly, bulb 56 and thickened portion 54 are formed by the matched mold flanges 62 and 64. The remainder of bag 20, including bag body 50 and possibly a lowermost portion of thickened portion 54 and/or a transition between body 50 and thickened portion 54, is formed during further deformation of billet 48 against an inner surface of mold 60. For example, a stretch rod may downwardly urge against a center of billet 48 to elongate it, after which air may be employed to blow the extended billet outwardly against the mold inner surface.

After thermoforming, upper mold flange 62 may move relative to lower mold flange 64, as indicated by the arrow in FIG. 7. Lower mold flange 64 may be integrally formed as part of the body of mold 60, as shown in FIG. 7, or mold flange 64 may be independent from the body of mold 60. In the embodiment shown, mold 60 may move downwardly away from a fixed upper mold flange 64 (as indicated by the arrow in FIG. 7), as such movement may facilitate removal of thermoformed bag 20 from mold 60.

Such a thermoforming process is capable of producing a great number of bags, such as bag 20, compared with conventional extrusion blow molded bags. For example, conventional thermoforming processes may produce 250,000 bags per day compared with a conventional extrusion blow molding process that may produce 15,000 bags per day.

Figure 1B:
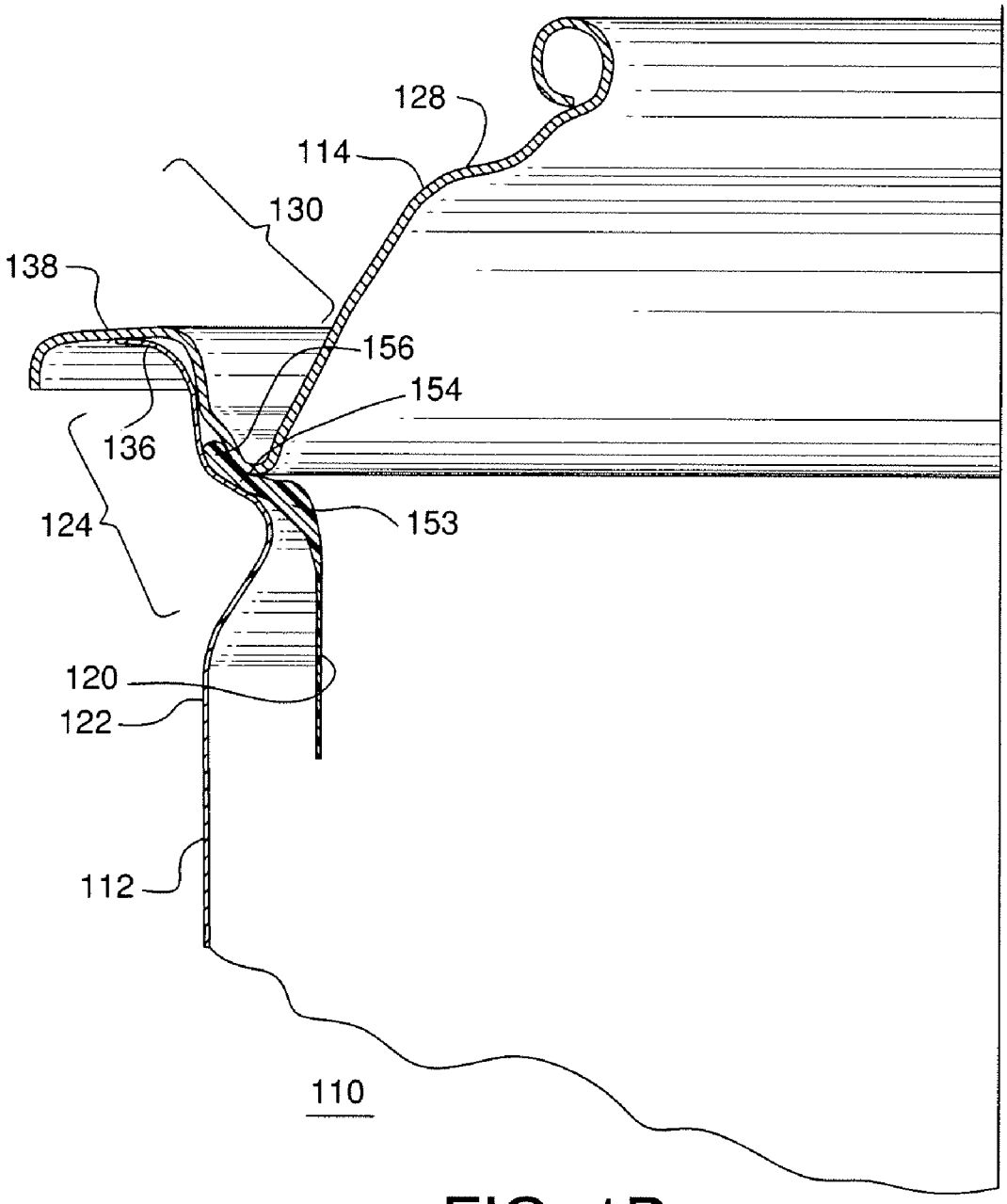
FIG. 1B illustrates a longitudinal cross sectional view of a portion of another embodiment of the can assembly.
Figure 2B:
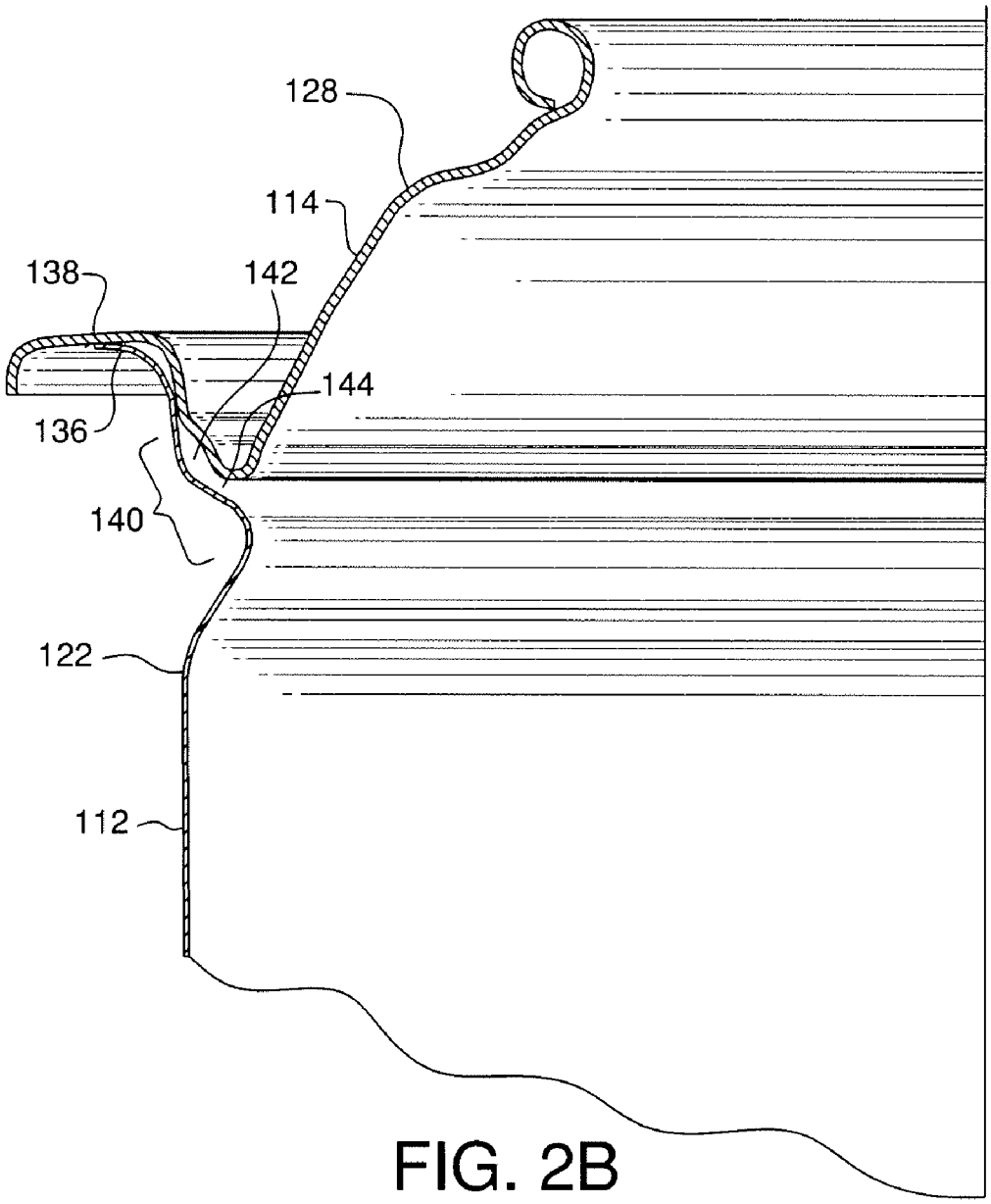
FIG. 2B is a cross sectional view of a portion of the can assembly shown in FIG. 1B, but with a portion removed for clarity.
Figure 3B:
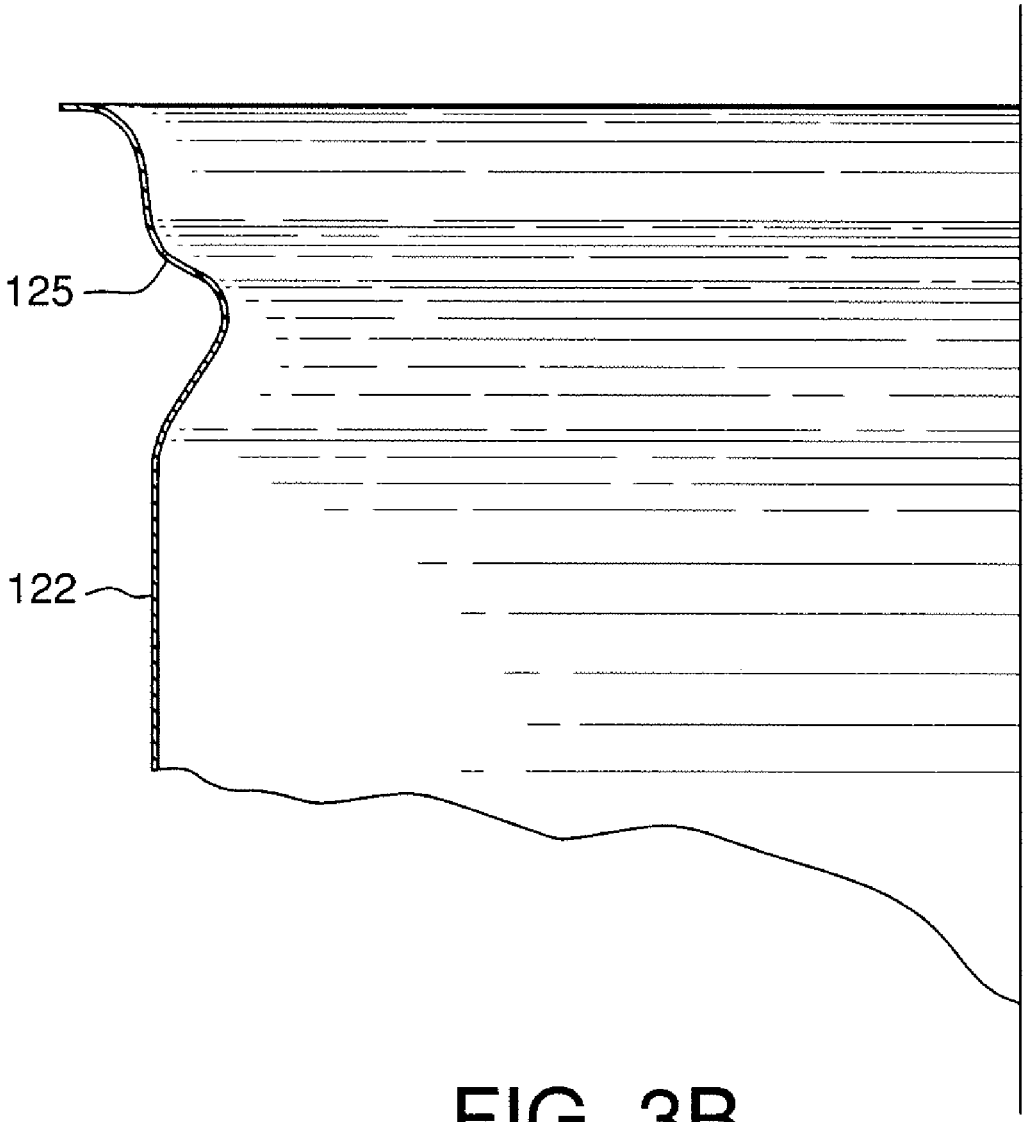
FIG. 3B is a cross sectional view of a portion of a component of the can assembly shown in FIG. 1B.

Another embodiment of the can assembly is illustrated in FIG. 1B, which shows a body 112 and a cap 114. Body 112 includes a sidewall 122 and a neck 124. As shown in FIGS. 1B, 2B, and 3B, body sidewall 122 yields to neck 24, which generally extends radially outward and upward. Neck 124 includes a throat portion 125. Body 112 is shown in a state prior to seaming such that distal end of neck 124 has a peripheral flange 136.

Figure 4B:
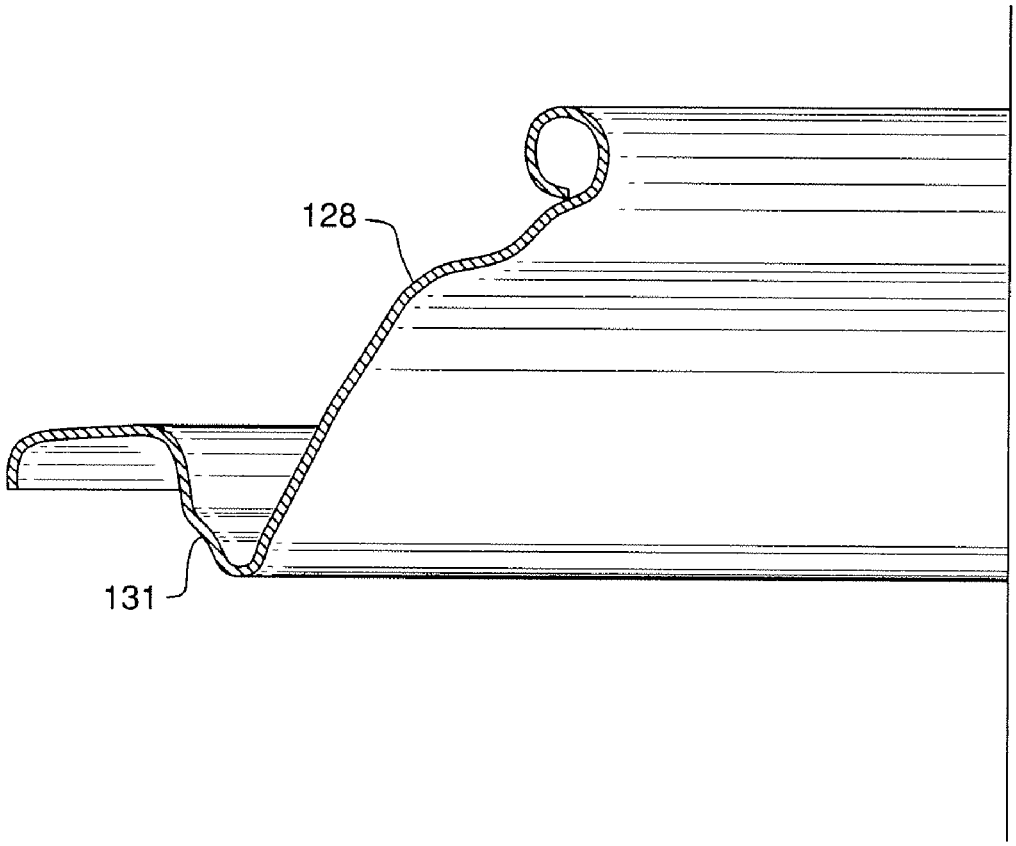
FIG. 4B is a cross sectional view of a portion of another component of the can assembly shown in FIG. 1B.

Cap 114 includes a cap sidewall 128 and a cap neck 130. Preferably, cap 114 is circular in transverse cross section (not shown in the Figures) so as to mate to body 112, and frustoconical shaped to a point where necks in toward its upper curl. As shown in FIGS. 1B, 2B, and 4B, cap sidewall 128, at its lower end, yields to neck 130, which extends radially outwardly and upwardly. Neck 130 includes a throat portion 131 and, at a distal end of neck 130, a peripheral flange 138.

FIG. 1B also shows another embodiment of the inner container, such as bag 120, which includes a circumferential bulb 156 at a distal tip thereof, an outer relatively thickened portion 154, and a inner relatively thickened portion 153 that is disposed radially inwardly relative to thick portion 154.

A portion of body neck 124 and cap neck 130 are mutually spaced apart to form a throat 140, which includes a constriction 144 at an entrance to throat 140 and an annulus 142. Annulus 142 has a height or minimum dimension (in longitudinal cross section as shown in FIG. 2B) that is greater than that of constriction 144. Constriction 144 and annulus 142 are formed by a throat portion 125 of body neck 124 and a throat portion 131 of container neck 130. Throat portion 125 of neck 124 is formed on a radially outwardly extending portion of body neck 124, and throat portion 131 is formed on a radially outwardly extending portion of cap neck 130.

In the embodiment shown in FIGS. 1B and 2B, both neck throat portion 125 and cap throat portion 131 include a concave section (as viewed from within throat 131) so as to form annulus 142. Constriction 144 is configured such that necks 124 and 130 contact outer thickened portion 154 in order to form a seal therewith between the propellant on the underside of flange 152 and the product contents inside bag 120.

Because bulb 56 has a dimension larger than the opening at constriction 144, bulb 156 prevents bag 120 from being pulled out (that is, radially inwardly) from throat 40. Inner thick portion 154 may prevent bag 120 from being forced radially outwardly through a throat 140. The features and, where appropriate, dimensions, of the embodiment shown in FIG. 1B may be like those as described with respect to the embodiment shown in FIG. 1A.

To form can assembly 10, cap 14 is positioned on body 12 such that cap neck 30 is disposed proximate body neck 24. Flanges (not shown in FIG. 1A or 1B) on each of the body neck 24 and cap neck 30 are deformed in a seamer, which may be conventional, to form seam 34. With necks 24 and 30 in an aligned position (as for example shown in FIG. 1A), and with bag flange 52 therebetween, seam 34 is formed to form the structure shown in FIG. 1. The description of forming the can assembly also generally applies to the embodiment shown in FIG. 1B.

The configurations disclosed herein illustrate particular embodiments of the present invention. The present invention, however, is not limited to the particular embodiments or configurations shown or explicitly described. Rather, the present invention encompasses numerous variations of the particular structure shown and described herein, as will be understood by persons familiar with conventional aerosol can technology in view of the present disclosure.

What is claimed is:

1. A method of forming a can assembly for dispensing a product under pressure, comprising the steps of:

a) providing a body including a body sidewall, a body neck, and a body seam portion disposed at a distal portion of the body neck;

b) providing a cap including a cap sidewall, a cap neck, and a cap seam portion;

c) providing an inner container including a flange having a bulbous end;

d) placing the flange of the inner container between the cap and the body such that (i) the bulbous end is disposed in an annulus formed between the body neck and the cap neck and (ii) a portion of the flange radially inward from the bulbous end is disposed in a constriction formed between the body neck and the cap neck proximate the annulus; and e) rolling the body seam portion and cap seam portion together to form a seam, whereby the seam is spaced apart from the bulbous end of the flange.

2. The method of claim 1 wherein the step of 1.c) providing an inner container comprises thermoforming the inner container.

3. The method of claim 2 wherein thermoforming the inner container comprises the steps of:

a) heating a billet;

b) disposing the billet into a mold;

c) deforming a portion of the billet to form the flange of the inner container; and d) deforming another portion of the billet to form the body of the inner container.

4. The method of claim 3 wherein the step of 3.c) deforming said portion of the billet includes deforming a periphery of the billet between a top mold flange and a bottom mold flange, wherein a space between the top mold flange and bottom mold flange has a shape corresponding the bulbous end of the inner container flange.

5. The method of claim 4 wherein at least one of the top mold flange and the bottom mold flange are movable to enable removal of the thermoformed inner container.

6. The method of claim 4 wherein the step of 3.d) deforming said other portion of the billet includes deforming a central portion with a stretch rod and blown air.

7. The method of claim 1 further comprising the steps of installing a nozzle in a top opening of the cap.

8. The method of claim 1 further comprising the steps of filling an interior of the inner container and pressurizing the can assembly at an exterior of the inner container.

* * * * *